United States Patent [19]

Von Holdt

[11] 4,452,382

[45] Jun. 5, 1984

[54] CONTAINER CLOSURE

[76] Inventor: John W. Von Holdt, 7430 N. Croname Rd., Niles, Ill. 60648

[21] Appl. No.: 319,933

[22] Filed: Nov. 10, 1981

[51] Int. Cl.[3] ..... B65D 25/44

[52] U.S. Cl. ..... 222/529; 222/541; 222/573; 220/270; 220/307

[58] Field of Search ..... 222/527, 528, 529, 530, 222/541, 566, 567, 569, 570, 573; 220/307, 270, 306

[56] References Cited

U.S. PATENT DOCUMENTS 2,661,128 12/1953 Rieke ..... 222/541 X 4,043,482 8/1977 Brown ..... 220/307

4,210,258 7/1980 Von Holdt ..... 220/306

*Primary Examiner*—Joseph J. Rolla

*Assistant Examiner*—Michael S. Huppert

*Attorney, Agent, or Firm*—Charles F. Pigott, Jr.

[57] ABSTRACT

A container having an open mouth is proportioned to receive a snap-on lid. An annular flange extends inwardly from the inner wall of the container about its circumference adjacent the mouth, with the flange extending toward the open mouth at an angle of 15° to 60° to the inner wall, to define an annular pocket between the flange and inner wall for receiving the snap-on lid.

29 Claims, 10 Drawing Figures

FIG. 1
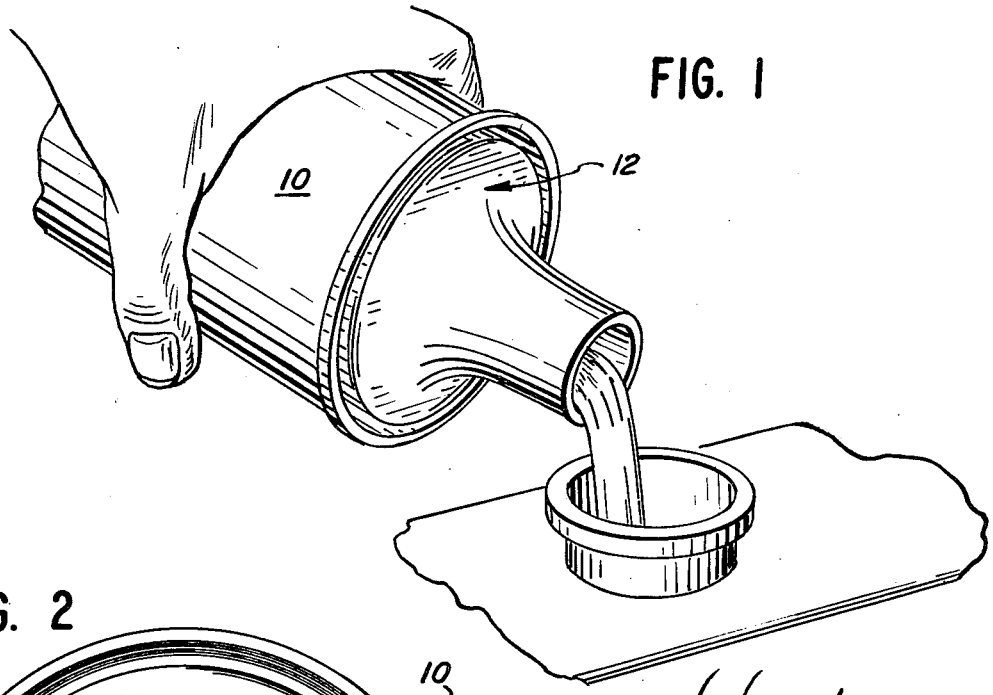
FIG. 2
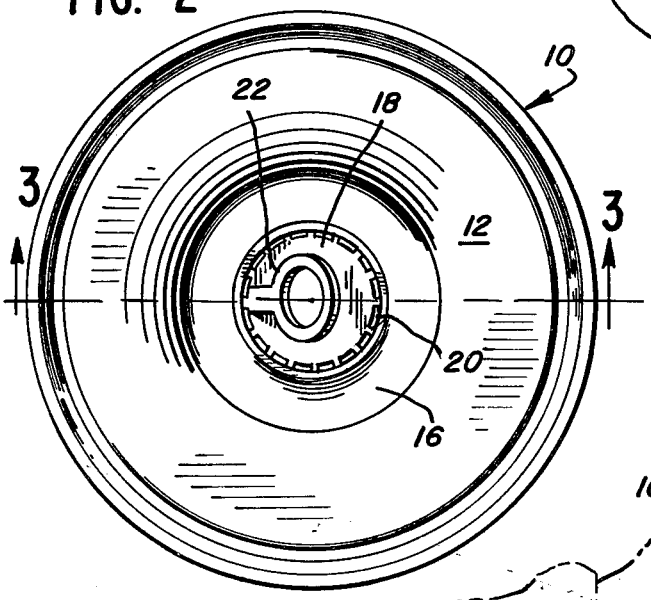
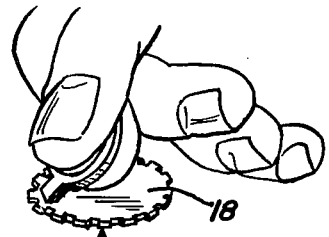
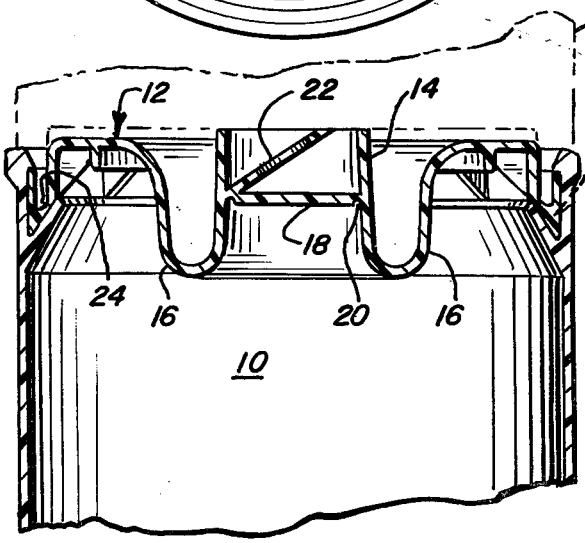
FIG. 3
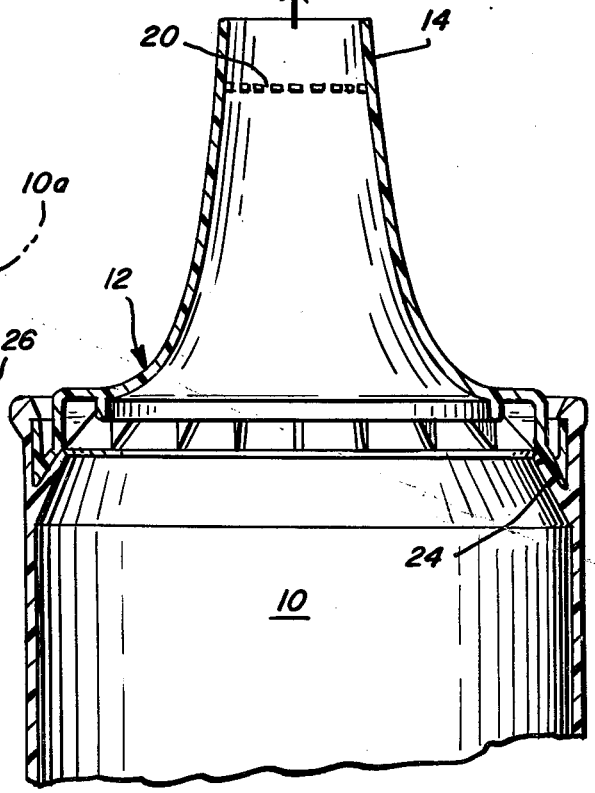
FIG. 4

FIG. 8
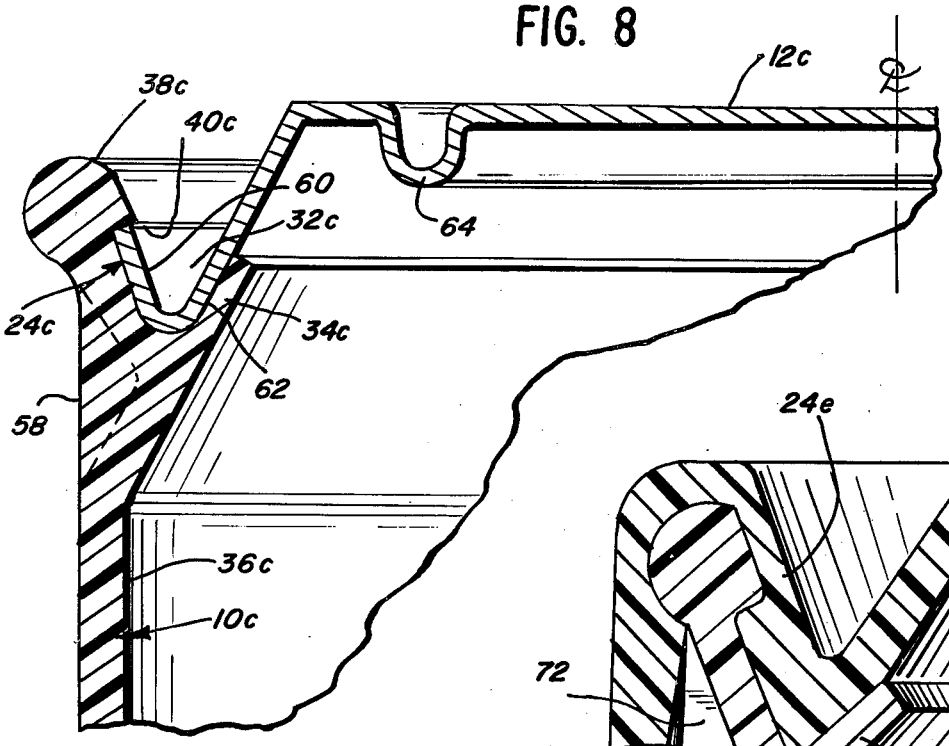
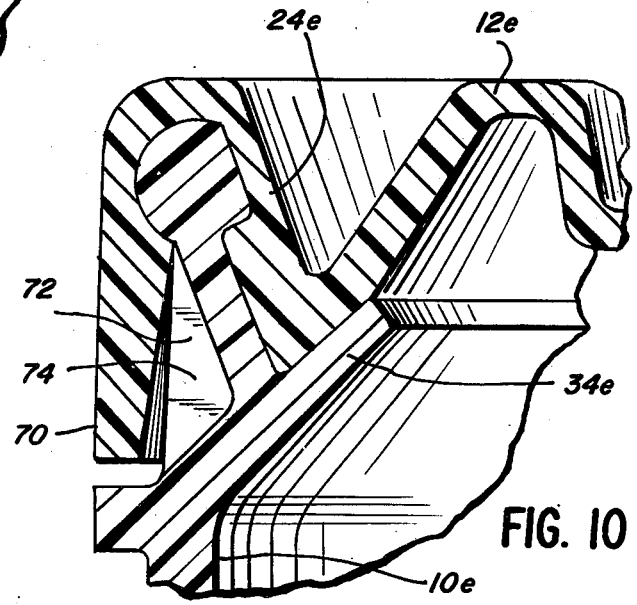
FIG. 10
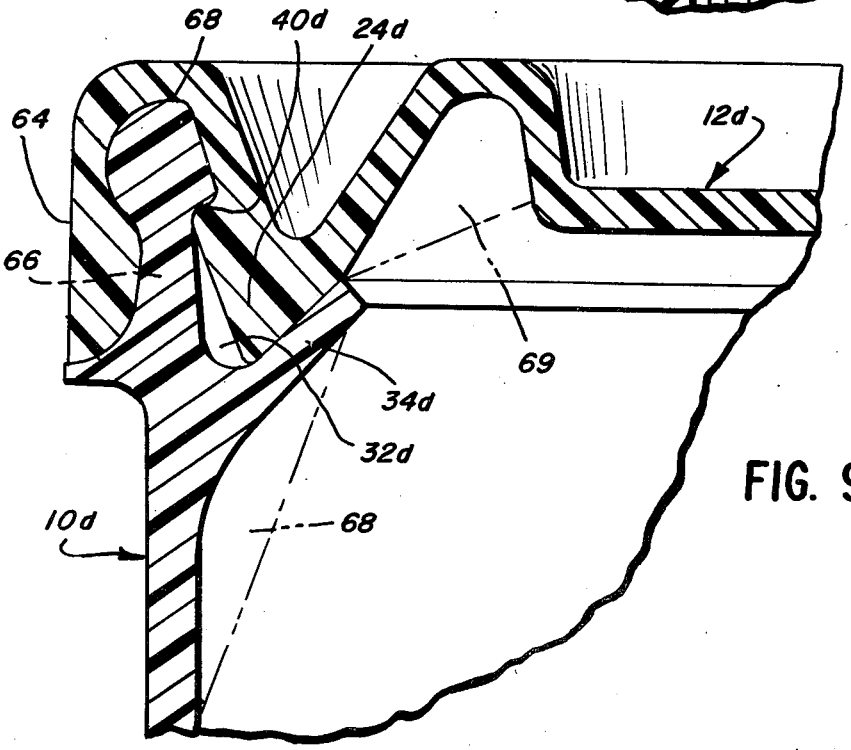
FIG. 9

CONTAINER CLOSURE

BACKGROUND OF THE INVENTION

This application relates to a new closure design for securing a lid to the mouth of a container. The design is easily molded, without complexities and multiple steps as in many prior art closures. The lid, once installed, may be designed to be nonremovable, or, alternatively, it may be of a removable design as shown herein. Also, the lid is easily insertable, but, once inserted, the filled container can resist the shock of being dropped, without the lid popping out from its position in the mouth of the container.

The container of this invention can be readily utilized as a container for motor oil or other liquid, containing a quart or a liter of liquid, or, alternatively, it may be used for large, one-gallon or five-gallon paint or chemical containers or drums. It may also be used in other containers of various sizes for holding any desired material.

In the Von Holdt copending U.S. application Ser. No. 101,220, now U.S. Pat. No. 4,308,970, filed Dec. 7, 1979 and entitled PLASTIC BUCKET DEFINING ANNULAR, INWARDLY-PROJECTING RIDGE AND METHOD, a bucket is disclosed having an annular, inwardly-projecting ridge adjacent the mouth in which the ridge extends inwardly in essentially perpendicular relation to the wall of the container.

Mirasol, Jr. U.S. Pat. No. 3,485,436 discloses a container and lid type structure in which the container carries an outer channel in which an annular, outer flange of the lid fits.

Norton U.S. Pat. No. 4,090,636 discloses a container lid with a springy, convoluted end that fits within an annular channel of a bucket having a double-walled lip.

McDonald U.S. Pat. No. 3,566,946 shows a bucket lid seal having an outwardly facing angled flange.

Von Holdt U.S. Pat. No. 4,210,258, at FIG. 8, shows a bucket and lid with an annular, angled rib extending toward the mouth of the bucket, the radially inner edge of the rib being gripped by the lid.

In this invention, distinct advantages have been found in the use of an annular flange which is typically straight and which extends inwardly from the inner wall of the container, while extending at an acute angle of substantially less than 90° to the inner wall.

DESCRIPTION OF THE INVENTION

In accordance with this invention a container is provided having an open mouth proportioned to receive a snap-on lid. A typically straight annular flange extends inwardly from the inner wall of the container about its circumference adjacent the mouth. The flange extends toward the open mouth at an angle of essentially 15° to 60° to the inner wall, to define an annular pocket between the flange and inner wall for receiving the snap-on lid. Preferably the angle of the flange is 20° to 40° or 45°, and the lid has a peripheral, annular enlargement proportioned to fit in the annular pocket.

It is also preferable for an inwardly extending annular step to be positioned above the annular pocket to define an annular recess with the pocket. As an equivalent to this, spaced step members distributed in an annular array in the same position may be used, being substantially equivalent to the inwardly extending annular step specifically shown herein, but with possibly less effective sealing.

Accordingly, when the peripheral, annular enlargement of the lid is forced into the pocket - particularly when the annular step is present to serve as a lock - the lip of the bucket is pushed outwardly as the lid is applied. Normally, it would be necessary to strongly reinforce the lip of the bucket to prevent excessive outward stretching at a cost of added plastic material necessary in each bucket to reinforce the lip for added hoop strength. This also would result in an unorthodox appearance in the container if it is intended for use as a paint bucket or the like.

In accordance with this invention, the flange extending outwardly of the mouth at a 15° to 60° angle serves as a counterbalancing aid as the lid is forced into position, when the lid is proportioned to press in its installed position against the outer surface of the flange. Thus, upon the installation of the lid, the peripheral, annular enlargement presses the lip of the bucket outwardly. However, the enlargement also presses the inwardly-extending flange of the bucket inwardly, providing a counterbalancing force, thus reducing the overall outward stretching of the bucket adjacent its lip. This provides added strength to the closure since the flange tends to be under inward stress by the presence of the lid, while the lip of the bucket is under outward stress with the flange serving as a counterbalance. Accordingly, the lip of the bucket does not have to be made as strong as would be otherwise required, due to the presence of the flange, while the container can still strongly resist accidental opening through dropping and the like.

The radially inner side of the annular flange is preferably substantially free of retentive contact with the lid.

It may be desired for the inner side of the annular flange and the inner wall of the container to be connected with longitudinal reinforcing ribs to limit inward bending of the flange. Likewise, radial ribs can connect the peripheral annular enlargement of the lid with the under surface of the lid, to also limit inward bending of the annular enlargement.

Slot means may be provided extending longitudinally of the container through the annular enlargement of the lid to permit removal of the lid by screwdriver or the like. Alternatively, no removal means may be provided, under which circumstance the lid can be designed to be effectively nonremovable except by destructive techniques.

The lid may be adapted to form a flexible wall about a port, which can alternatively occupy an inner, convoluted position for storage and an outwardly extending position to serve as a pour spout in a manner analogous to the disclosure of Von Holdt U.S. Pat. No. 4,280,976.

DESCRIPTION OF THE DRAWINGS

Referring to the drawings,

FIG. 1 is a perspective view of one embodiment of the container of this application with the lid attached.

FIG. 2 is a plan view of the container of FIG. 1.

FIG. 3 is a fragmentary sectional view taken along line 3—3 of FIG. 2.

FIG. 4 is a sectional view similar to FIG. 3, showing the spout of the container in its extended configuration.

FIGS. 8, 9 and 10 are fragmentary, sectional views of other embodiments of the container and lid of this invention.

DESCRIPTION OF SPECIFIC EMBODIMENT

Figure 5:
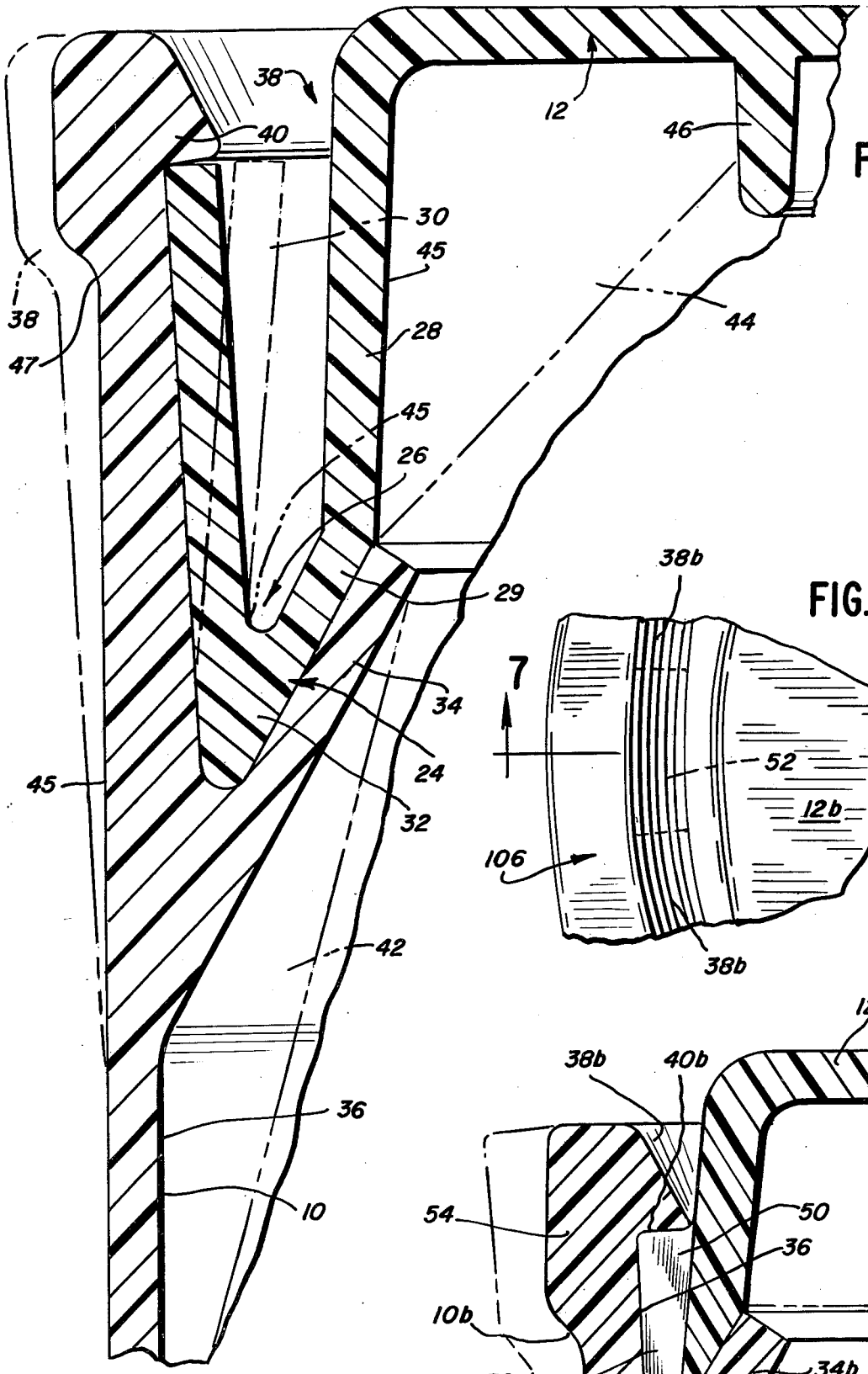
FIG. 5 is an enlarged, fragmentary sectional view of a portion of the sectional view of FIG. 3.

Referring to FIGS. 1–5, an embodiment of this invention is disclosed which is a plastic bottle or can having an integral, extendible pour spout and which may be used for holding motor oil, chemicals, soft drinks, or any other materials as may be desired.

Container 10 may be an injection-molded, preferably straight-walled plastic bottle or bucket having an open mouth and proportioned to receive in such open mouth a snap-on lid 12, which may also be made of molded, flexible plastic. As shown in FIG. 3, the spout 14 of lid 12 may be in a retracted position, with portions of the lid forming an annular convolution 16 about spout 14. For example, the container of this invention may be stacked in this configuration with another container of similar design 10*a* shown in phantom lines, stacked on top of container 10. Lid 12 is generally permanently attached to container 10 in this embodiment.

Spout 14 carries a sealing wall 18 having a peripheral, weakened portion 20 where the plastic is thinner. The weakened portion may comprise thin spots strong enough to retain the seal, but thin enough to permit easy tearing removal of sealing wall 18 when tab 22 is pulled by the fingers. Thus, one grasps tab 22 with the fingers while the container is in the configuration of FIG. 3, pulling it to cause the spout 14 to advance. As annular convolution 16 unfolds as spout 14 has advanced, further pulling can cause perihperal, weakened area 20 to be ruptured, and sealing wall 18 to be removed so that the contents of the container may be poured out through the spout. In this invention the lid may be, in some circumstances, made of metal or other material as desired, but in this present embodiment is shown to be made of plastic.

The plastic lid 12 has a peripheral, annular enlargement 24, which fits in an annular pocket 26 as defined adjacent the lip of container 10, in the interior thereof.

Referring particularly to FIG. 5 for details of the sealing connection between annular enlargement 24 of lid 12 and annular pocket 26 of container 10, the peripheral, annular enlargement 24 of snap-on lid 12 comprises, in cross section, a generally U-shaped double wall including inner wall 28 and outer wall 30 connected with inner wall 28 at bottom area 32 and having generally parallel sections (at least within 10° of each other). Angled section 29 of inner wall 28 provides a wide seal with annular flange 34.

The U-shaped double wall system 28, 30 is proportioned to fit into annular pocket 26, which in turn, is defined by annular flange 34 which extends inwardly from the inner wall 36 of container 10 and extends about its inner circumference adjacent the mouth 38 of the container. Flange 34 extends toward open mouth 38 at an angle of 15° to 60° (and preferably about 30°) to the inner wall to define the annular pocket 26 described above. It has been found that the existence of flange 34 significantly improves the hoop strength of the mouth of container 38, and makes it possible to produce a sturdy container with reliable sealing, with the use of less plastic in the general vicinity of open mouth 38.

It is also preferred for the container to define an inwardly extending annular step 40 positioned above the annular pocket 26 to define an annular recess with the pocket, which may be occupied for example by outer wall 30 of the lid for locking relationship between lid 12 and container 10. Thus, as shown, lid 12 may snap into position as it is installed. Outer wall 30 as shown in phantom will be bent inwardly by annular step 40, and correspondingly lip 38 of bucket 10 will be bent outwardly. However, as lid 12 is snapped into position, inner wall 28 presses against annular flange 34, causing the above-described counterbalancing force urging the retraction of lip 38 back to its normal position and tending to hold it there.

Annular flange 34 may be optionally connected to longitudinal reinforcing ribs 42 which connect the inner side of annular flange 34 with the inner wall 36 of the bucket to limit inward bending of the flange. Ribs 42 are shown in phantom to emphasize the fact that their presence is optional, but preferred, and that their number and shape can equally be varied to properly adjust the rigidity of flange 34 to a desired level.

Similarly, inner wall 28 of the peripheral annular enlargement of lid 12 may carry optional radial ribs 44 extending between a radially inward facing surface 45 of wall 28 and the under surface of lid 12 as shown, and optionally abutting against annular ring 46. Radial ribs 44 are likewise shown in phantom lines to emphasize their optional (but preferred) nature, and the fact that the number present and their shape can be varied as desired to provide the proper characteristics of rigidity to inner wall 28 of the peripheral annular enlargement. Radial ribs 45 may also be used for further reinforcement, if desired.

It can be seen from FIGS. 1–5 that lid 12 is essentially nonremovable. Thus the container 10 may be filled with its contents, and lid 12 applied in conventional manner by snapping into the relationship shown in FIG. 5. A long, compressed sealing surface may be provided along the junction line of wall 28 and annular flange 34, and also the junction line of wall 30 and the inner bucket wall of bucket 10, so that good sealing may be provided.

An integral spout may also be present as shown and an easily removable sealing wall or tab 18. The materials used in this container may be polypropylene, polyethylene, polyethylene terephthalate, or other known plastic materials as may be desired to obtain the desired physical properties for the container.

It may be desired to shorten the distance of bucket 10 and annular enlargement 24 between points 45 and 47, for example by about one third, if one wishes to have a stiffer, less flexible closure system.

Figure 6:
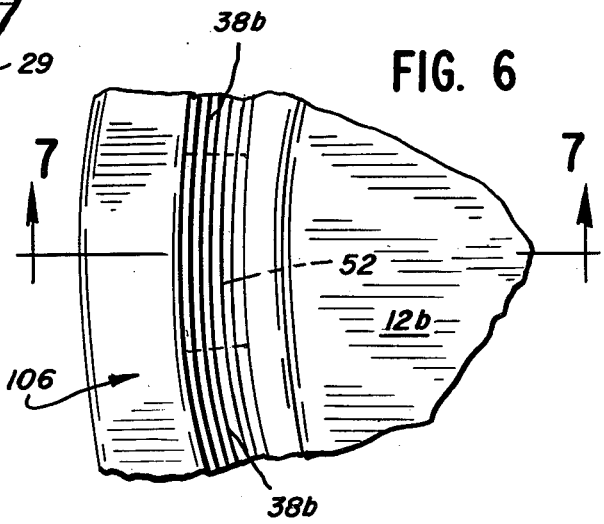
FIG. 6 is an enlarged, fragmentary plan view of another embodiment of the container and lid of this invention.
Figure 7:
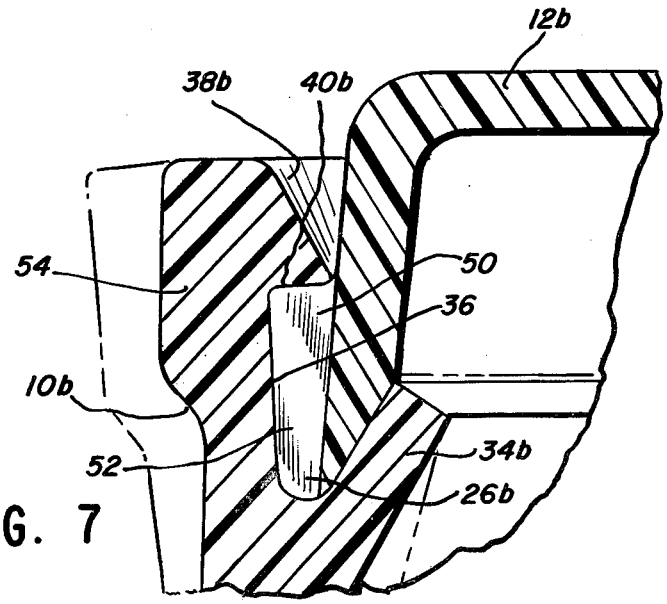
FIG. 7 is a sectional view taken along line 7—7 of FIG. 6.

Referring to FIGS. 6 and 7, a variant in the design of the container of this invention is disclosed. This particular design may be useful for a paint bucket or the like where the lid 12*b* may be removed.

In a manner analogous to the previous embodiment, container 10*b* is provided with an annular flange 34*b* extending at an angle of about 30° to the inner wall 36 of the bucket, thus defining a pocket 26*b* similar to pocket 26 of FIG. 5. Inwardly-extending annular step 40*b* is also provided, and lid 12*b* includes the peripheral, annular enlargement 50 which in this instance is made of essentially solid plastic. Bucket lip 38*b* is also shown.

In this particular instance, one or more longitudinal slots 52 are provided in the annular enlargement 50. Thus one may insert a screwdriver or the like into slots 52, past annular step 40*b*, prying against the wall 54 of the bucket to force lid 12*b* out of its snap-fit, locked position for opening of the container.

Referring to FIG. 8, an embodiment of the container of this invention is disclosed in which a container 10*c*, which may be injection-molded out of plastic, carries a sheet metal lid 12c. As in the previous embodiments, flange 34c is provided in the same angular relation to the inner wall 36c of the container to achieve the benefits of this invention. Pocket 32c is thus defined, with inwardly-extending annular step 40c being positioned at an angle, relative to the prior examples of the annular step, and proportioned to retain peripheral annular enlargement 24c, which includes two annular walls 60, 62 of the sheet metal lid, folded into angular arrangement when viewed in cross section.

Annular convolution 64 is provided for flexibility of the lid 12c. An optional annular recess having spaced, vertical ribs 58 distributed about the container periphery may also be provided as shown.

As in the previous embodiments, flange 34c provides hoop strength to the lip area of the container, and reinforces outer lip 38c so that it does not bend unduly outwardly when lid 12c is snapped into place.

Lid 12c may carry a conventional spout, a port, or the like, or longitudinal slots similar to slots 52 may be defined in bucket 10c to permit removal of lid 12c. It should be noted that longitudinal slots extending in from the lip of the container are preferred over transverse slots which cut through the entire wall of the container in the area of the lip, since that tends to reduce the hoop strength of the container.

All of the previous embodiments include lids which do not extend over the lip of the container but are totally retained within the mouth of the container.

Referring to FIG. 9, a container of an overall type similar to that shown in U.S. Pat. No. 4,210,258 and the previously cited U.S. application is shown. Bucket 10d carries a similar inwardly-projecting annular flange 34d, similar in function to the previously described flanges. Bucket lid 12d carries peripheral annular enlargement 24d and beyond it an added flange 64 to define an annular recess 66 which is proportioned to receive the lip 68 of the bucket. Annular enlargement 24d is proportioned to fit securely within annular pocket 32d but does not necessarily follow its exact contours. Thus, annular enlargement 24d is firmly retained in pocket 32d between annular flange 34d and inwardly-extending annular step 40d for retention in a manner similar to the previous embodiments.

Optional ribs 68, 69 may be used, if desired, as in previous embodiments.

In FIG. 10, another design is shown. Container 10e has annular flange 34e as in previous embodiments. Lid 12e has its peripheral enlargement 24e as before. An annular added outer flange 70 is also provided.

Annular recess 72 is also provided, plus a plurality of spaced vertical ribs 74 distributed in annular recess 72 for strength.

The annular enlargements 24 of the various lids 12 also provide a blunt, noncutting edge, which is an advantage over a cut metal can top.

The above has been offered for illustrative purposes only and is not intended to limit the scope of the invention of this application which is as defined in the claims below.

That which is claimed is:

1. In a container having an open mouth proportioned to receive a snap-on lid, an annular straight flange extending inwardly from the inner wall of said container about its circumference adjacent said mouth, said flange extending toward said open mouth at an angle of 15° to 60° to the inner wall, to define an annular pocket between said flange and inner wall for receiving and retaining said snap-on lid, and an annular step extending inwardly from said inner wall toward the center of said container at a position above said annular pocket to define an annular recess with said pocket for contacting a portion of said lid.

2. The container of claim 1 in which said angle is 20° to 45°.

3. The container of claim 1 which carries a lid having a peripheral, annular enlargement proportioned to fit in said annular pocket.

4. The container of claim 3 in which the radially inwardly-facing lateral surface of said flange is free of retaining contact with the lid.

5. The container of claim 3 in which said peripheral, annular enlargement is made of solid plastic.

6. The container of claim 3 in which said peripheral, annular enlargement is made of folded metal sheet.

7. The container of claim 1 in which longitudinal reinforcing ribs connect the inner side of said annular flange and the inner wall to limit inward bending of said flange.

8. The container of claim 1 which carries said snap-on lid, said lid having a peripheral, annular enlargement comprising, in cross section, a generally U-shaped double wall.

9. The container of claim 8 in which said peripheral annular enlargement is of U-shaped double wall cross section defining an outer annular wall and inner wall of the U-shaped cross section, said outer wall fitting in said pocket in a position whereby the free edge abuts said inwardly-extending annular step for firm retention of the snap-on lid in the container mouth and said inner annular wall fitting in said pocket for contact with said flange without retention contact.

10. The container of claim 8 in which said peripheral, annular enlargement is connected to radial ribs extending between a radially inwardly-facing surface of said enlargement and the under surface of said lid, to limit inward bending of said annular enlargement.

11. The container of claim 1 which carries said snap-on lid, said lid having a peripheral, annular enlargement, and slot means extending longitudinally through said annular enlargement to facilitate opening of the container.

12. The container of claim 1 in which said lid carries an openable port and a flexible wall about said openable port which can alternatively occupy an inner, convoluted position for storage and an outwardly-extending position to serve as a pour spout.

13. In a container having anopen mouth proportioned to receive a snap-on lid, an annular flange extending inwardly from the inner wall of said container about its circumference adjacent said mouth, said flange extending toward said open mouth at an angle of 15° to 60° to the inner wall to define an annular pocket between said flange and inner wall receiving said snap-on lid, and an inwardly-extending annular step positioned above said annular pocket to define an annular recess with said pocket, said annular step extending from said inner wall inward toward the center of said container, said lid having a peripheral, annular enlargement proportioned to fit in said annular pocket, the radially inwardly-facing lateral surface of said flange being free of retentive contact with said lid.

14. The container of claim 13 in which radial ribs extend between a radially inwardly-facing surface of said annular enlargement and the undersurface of said lid, to limit inward bending of said annular enlargement.

15. The container of claim 14 in which said angle is 20° to 45°.

16. The container of claim 15 in which longitudinal reinforcing ribs connect the inner side of said annular flange and the inner wall to limit inward bending of said flange.

17. The container of claim 15 in which the cross section of said peripheral annular enlargement of the lid defines a generally U-shaped double wall.

18. The container of claim 15 in which said peripheral annular enlargement is made of solid plastic.

19. The container of claim 18 in which slot means extend longitudinally through said peripheral annular enlargement to facilitate opening of the container.

20. The container of claim 15 in which said peripheral annular enlargement is made of folded metal sheet.

21. In a container having an open mouth proportioned to receive a snap-on lid, an annular flange extending inwardly from the inner wall of said container about is circumference adjacent said mouth, said flange extending toward said open mouth at an angle of 20° to 50° to the inner wall to define an annular pocket between said flange and inner wall for receiving said snap-on lid, said container carrying a lid having a peripheral, annular enlargement proportioned to fit in said annular pocket, and an inwardly extending, annular step positioned above said annular pocket on said inner wall to define an annular recess with said pocket into which the peripheral annular enlargement fits, a portion of said annular enlargement being arranged to deflect during snap-on insertion of said lid into said pocket, and said annular enlargement having another portion being retained by said annular step.

22. The container of claim 21 in which longitudinal reinforcing ribs connect the inner side of said annular flange and the inner wall to limit inward bending of said flange.

23. The container of claim 21 in which said peripheral annular enlargement comprises, in cross section, a generally U-shaped double wall.

24. The container of claim 23 in which said peripheral annular enlargement is of U-shaped double wall cross section defining an outer annular wall of the U-shaped cross section, said outer wall fitting in said pocket in a position whereby a longitudinally outer end thereof abuts said inwardly-extending annular step for firm retention of the snap-on lid in the container mouth.

25. The container of claim 21 in which said peripheral, annular enlargement is made of solid plastic.

26. The container of claim 21 in which said lid is made of metal sheet, with said peripheral, annular enlargement being made of folded metal sheet as an integral part of the rest of said lid.

27. The container of claim 26 which carries an annular convolution at a position radially inward from said annular enlargement to increase the flexibility of said lid.

28. The container of claim 21 in which said lid carries an openable port and a flexible wall about said openable port which can alternatively occupy an inner, convoluted position for storage and an outwardly-extending position to serve as a pour spout.

29. In a container having an open mouth proportioned to receive a snap-on lid, an annular flange extending inwardly from the inner wall of said container about its circumference adjacent said mouth, said flange extending toward said open mouth at an angle of 20° to 50° to the inner wall to define an annular pocket between said flange and inner wall for receiving said snap-on lid, said container carrying a lid having aperipheral, annular enlargement proportioned to fit in said annular pocket, and an inwardly extending, annular step positioned above said annular pocket to define an annular recess with said pocket into which the peripheral annular enlargement fits, said peripheral annular enlargement comprises, in cross section, a generally U-shaped double wall, said peripheral annular enlargement is connected to radial ribs extending between a radially inwardly-facing surface of said enlargement and the under surface of said lid, to limit inward bending of said annular enlargement.

* * * * *